US009375062B2

(12) United States Patent
Collins et al.

(10) Patent No.: US 9,375,062 B2
(45) Date of Patent: Jun. 28, 2016

(54) FLEXIBLE SPORTS BAG

(71) Applicant: GRIT INC., Tottenham (CA)

(72) Inventors: Gregory James Collins, Loretto (CA); Matthew Gordon Thomas Hughson, Vaughn (CA); Erin Dawn Dobo, Barrie (CA)

(73) Assignee: Grit Inc., Loretto, Ontario (CA)

( * ) Notice: Subject to any disclaimer, the term of this patent is extended or adjusted under 35 U.S.C. 154(b) by 4 days.

(21) Appl. No.: 14/160,111

(22) Filed: Jan. 21, 2014

(65) Prior Publication Data

US 2014/0202897 A1 Jul. 24, 2014

Related U.S. Application Data

(60) Provisional application No. 61/754,814, filed on Jan. 21, 2013.

(51) Int. Cl.

| | |
|---|---|
| ***A45C 13/04*** | (2006.01) |
| ***A45C 5/14*** | (2006.01) |
| ***A45C 7/00*** | (2006.01) |
| *A45C 3/00* | (2006.01) |

(52) U.S. Cl.

CPC ..... *A45C 5/14* (2013.01); *A45C 7/0022* (2013.01); *A45C 13/04* (2013.01); *A45C 2003/007* (2013.01)

(58) Field of Classification Search

CPC ..... A45C 7/0077; A45C 2003/007; A45C 13/04; A45C 7/0036; A63B 71/0036

USPC ..... 190/107, 127, 103, 124; 383/33, 104

See application file for complete search history.

(56) References Cited

U.S. PATENT DOCUMENTS

| | | | | |
|---|---|---|---|---|
| 2,115,308 | A | 4/1938 | Koch | |
| 2,710,084 | A | 6/1955 | Braverman | |
| 2,718,943 | A | 9/1955 | Braverman | |
| 4,433,933 | A * | 2/1984 | Parsons et al. | 403/268 |
| 5,031,734 | A * | 7/1991 | King | 190/122 |
| 5,118,130 | A | 6/1992 | Kaltz | |
| 5,139,308 | A | 8/1992 | Ziman | |
| 5,178,245 | A * | 1/1993 | Cox | 190/107 |
| 5,439,241 | A | 8/1995 | Nelson | |
| 5,450,957 | A * | 9/1995 | Erb | 206/315.11 |
| 5,476,184 | A | 12/1995 | Hill | |
| 5,499,760 | A | 3/1996 | Pielocik | |

(Continued)

FOREIGN PATENT DOCUMENTS

| | | |
|---|---|---|
| CA | 1226567 | 9/1987 |
| CA | 1319939 | 7/1993 |

(Continued)

*Primary Examiner* — Sue A Weaver

(74) *Attorney, Agent, or Firm* — Frost Brown Todd LLC

(57) ABSTRACT

The present invention replaces the traditional steel and plastic construction primarily used in sports equipment bags to provide a novel sports equipment bag with flexibility, durability, strength, and a net weight reduction. The sports bag of the present invention integrates optionally removable composite rods into the frame structure of a sports bag to allow for significant flexibility and compression thereof for general transport, storage, shipping and handling purposes, and yet the sports bag is also capable of holding a semi-rigid exterior to a given volume and shape when in regular use. The present invention also discloses a sports equipment bag with a novel folding floor to assist with the flexible and collapsible nature of a sports equipment bag.

15 Claims, 16 Drawing Sheets

(56) References Cited

U.S. PATENT DOCUMENTS

| | | | | |
|---|---|---|---|---|
| D374,773 | S | 10/1996 | Domotor | |
| 5,762,438 | A * | 6/1998 | Reed, II | 403/269 |
| 5,797,612 | A | 8/1998 | Buccioni | |
| 5,918,710 | A | 7/1999 | Sher | |
| 6,062,357 | A | 5/2000 | Bogert | |
| 6,264,078 | B1 | 7/2001 | Bilang | |
| D459,883 | S | 7/2002 | Worell et al. | |
| 6,443,274 | B1 | 9/2002 | Klamm | |
| D471,013 | S | 3/2003 | Peterson | |
| 6,763,940 | B1 | 7/2004 | Lai | |
| 6,874,797 | B2 | 4/2005 | Gardenour | |
| 6,932,427 | B2 | 8/2005 | Tamura | |
| 6,997,507 | B2 | 2/2006 | Rhee | |
| 7,757,912 | B1 | 7/2010 | Fabro | |
| D640,054 | S | 6/2011 | Custer | |
| D662,319 | S | 6/2012 | Collins et al. | |
| 8,453,812 | B2 | 6/2013 | Xiao | |
| 2004/0065518 | A1 | 4/2004 | Hoberman | |
| 2005/0034948 | A1 | 2/2005 | Tiramani | |
| 2008/0023282 | A1 | 1/2008 | Duncan | |
| 2009/0183961 | A1 | 7/2009 | Whalen et al. | |
| 2009/0255770 | A1 | 10/2009 | Slater | |
| 2011/0162931 | A1 | 7/2011 | Collins et al. | |
| 2012/0024649 | A1 * | 2/2012 | Lai | 190/24 |
| 2012/0090934 | A1 * | 4/2012 | Keir | 190/18 A |

FOREIGN PATENT DOCUMENTS

| | | |
|---|---|---|
| CA | 1321568 | 8/1993 |
| CA | 2145612 | 8/1999 |
| CA | 2327764 | 6/2002 |
| CA | 117465 S | 1/2008 |
| CA | 2581636 | 9/2008 |
| CN | 201164134 | 12/2008 |
| WO | 2008021793 | 2/2008 |
| WO | 2011082468 | 7/2011 |

* cited by examiner

Prior Art

FLEXIBLE SPORTS BAG

CROSS-REFERENCE TO RELATED APPLICATION

This application claims priority from U.S. Provisional Application Ser. No. 61/754,814, filed Jan. 21, 2013, the disclosure of which is incorporated herein by reference.

FIELD OF THE INVENTION

This invention relates to a bag for holding and transporting articles. More particularly, this invention relates to a bag for carrying sports equipment. Specifically, this invention relates to a sports bag with a flexible frame construction and, optionally, a folding floor, which sports bag may be folded and is collapsible into a smaller profile or overall volume for easier storage, transport, shipping and handling.

BACKGROUND OF THE INVENTION

Athletic equipment bags, or sports bags as they are often commonly referred, are becoming increasingly popular in numerous sports because of their functionality and attractiveness to athletes. They are typically quite large, however, in order to allow a sports participant to carry all the equipment he or she needs for games and practice sessions. In this respect, a hockey player, for example, may require his or her sports bag to carry at least one stick, a pair of skates, a helmet, gloves, shoulder and shin pads, elbow pads, pants, a jersey, neck guard, socks, athletic support, etc. Goalies need even more equipment, requiring large goalie pads as well.

Heretofore, conventional sports bags generally include two types. The first type is made from soft material (nylon, canvas, cloth, or leather, for example), is not capable of maintaining a given shape and volume per se, and cannot protect the storage items against impact. FIG. 1 provides two "duffle bag" examples of such a sports bag. Not only does such a soft bag provide an awkward means of transporting equipment, but it is typically very difficult to find a particular piece of equipment within such a large carry bag as they typically are not compartmentalized. In fact, it is often necessary to rummage through all of the equipment (and necessitates the removal of much of the equipment from the bag) while a search is made for the desired article.

The second type of sports bag has a rigid structure, often having an outer, substantially rigid cover structure to provide greater support to prevent items within the bag from being damaged by compression. While these types of rigid sports bags effectively protect the storage items against impact, they are typically heavy, not convenient to carry, and can be quite bulky and difficult to transport. For example, U.S. Pat. No. 5,797,612 entitled "Sports Equipment Carrier", issued Aug. 25, 1998 to Aldo Buccioni, disclosed a novel carrier for hockey equipment. This hockey equipment carrier comprised an upright container (generally rectangular in shape), having a body with internal receptacles for receiving equipment, door means for access to the internal space, a lower end with wheels to assist in transport, and means for releasably securing hockey sticks to the container. Unfortunately, however, because of the large size of the carrier given the various equipment that the participant needs, in combination with the rigid structure of the carrier which enables the bag to hold its shape and volume, this prevents such a bag from fitting comfortably into the trunks of motor vehicles, lockers, storage facilities, and the like, and is bulky for shipping and handling, thereby increasing costs associated therewith. Furthermore, such rigid structure sports bags are inflexible and cannot adequately bend and flex to absorb shock, or to collapse for storage or transport. A need therefore exists for a sports bag that has a semi-rigid structure to provide necessary support and to protect its contents from damage, and allow for compartmentalization within the sports bag, but that is also flexible and collapsible for ease of storage, transport, shipping, and handling.

BRIEF SUMMARY OF THE INVENTION

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

The present invention seeks to overcome deficiencies in prior art sports equipment bags by employing Grit Inc.'s novel Torsion Technology™, disclosed herein, which allows for a sports bag that has the necessary rigidity to support and protect its contents from damage when in regular use, but that is also flexible and sufficiently collapsible for easier storage, transport, shipping and handling.

The present invention also provides a sports equipment bag with a folding floor to assist with the flexible and collapsible nature of the bag.

In one embodiment, the invention comprises a flexible sports bag comprising: a flexible body defining an interior compartment, said body comprising a front panel, a back panel, a top panel, a bottom panel, and first and second side panels; a flexible subframe disposed in the interior compartment to which the flexible body is affixed, said subframe comprising: a first removable linear rod that extends vertically substantially the height of the back panel from a location proximate a junction of the back panel, the bottom panel and the first side panel to a location proximate a junction of the back panel, the top panel and the first side panel; a second removable linear rod that extends vertically substantially the height of the back panel from a location proximate a junction of the back panel, the bottom panel and the second side panel to a location proximate a junction of the back panel, the top panel and the second side panel; a first flexible angled rod that is releasably engageable with a first rod holder located proximate to the junction of the back panel, the top panel and the first side panel and that is capable of releasably engaging with a second rod holder located proximate to a junction of the front panel, the bottom panel and the first side panel; and a second flexible angled rod that is releasably engageable with a third rod holder located proximate to the junction of the back panel, the top panel and the second side panel and that is capable of releasably engaging with a fourth rod holder located proximate to a junction of the front panel, the bottom panel and the second side panel, wherein, when the first flexible angled rod is engaged with the first and second rod holders and the second flexible angled rod is engaged with the third and fourth rod holders, said flexible angled rods and linear rods maintain the flexible body in a semi-rigid but semi-compressible state, and wherein, when the first flexible angled rod is engaged with at most one of the first and second rod holders and the second flexible angled rod is engaged with at most one of the third and fourth rod holders, said flexible body is compressible for any one or more of storage, transport, shipping or handling.

In another embodiment, the flexible body may comprise soft-sided nylon, canvas or polyester.

In a further embodiment, the first and second removable linear rods of the sports bag are flexible.

In yet another embodiment, the first and second removable linear rods comprise any one of carbon fibre, pultrusion fiberglass, or pultrusion fiberglass with glass-fibre reinforced polymer or plastic material comprising epoxy, a thermosetting plastic or thermoplastic.

In yet another embodiment, the first and second removable linear rods comprise pultrusion fiberglass with glass-fibre reinforced with a plastic composite material comprising non-homogeneous thermoplastic resin.

In yet another embodiment, the first and second removable linear rods are 0.375" in diameter.

In yet another embodiment, the first and second flexible angled rods comprise any one of carbon fibre, pultrusion fiberglass, or pultrusion fiberglass with glass-fibre reinforced polymer or plastic material comprising epoxy, a thermosetting plastic or thermoplastic.

In yet another embodiment, the first and second flexible angled rods comprise pultrusion fiberglass with glass-fibre reinforced with a plastic composite material comprising non-homogeneous thermoplastic resin.

In yet another embodiment, the first and second flexible angled rods are 0.25" to 0.27" in diameter.

In yet another embodiment, the first and second rod holders comprise an opening section to releasably and frictionally engage or house the distal ends of the first flexible angled rod and the third and fourth rod holders comprise an opening section to releasably and frictionally engage or house the distal ends of the second flexible angled rod.

In yet another embodiment, the rod holders comprise an opening that is tapered.

In yet another embodiment, the rod holders are fabricated from plastic, fabric, metal, or synthetic plastic material.

In yet another embodiment, the rod holders are fabricated from injection molded polyethylene plastic.

In yet another embodiment, the rod holders are engaged with the first and second side panels by riveting said side panels to a plastic board.

In yet another embodiment, the first flexible angled rod is engageable with at least one side attachment affixed to an interior side of the first side panel and the second flexible angled rod is engageable with at least one side attachment affixed to an interior side of the second side panel.

In yet another embodiment, the side attachments comprise velcro attachments, loops of fabric stitched to the first and second side panels, or U-shaped portions of plastic stitched or riveted to the first and second side panels.

In yet another embodiment, the bottom panel further comprises a flexible floor portion that is vertically foldable along a lateral length of said bottom panel to increase the compressibility of the sports bag.

In yet another embodiment, the folding of the flexible floor portion is controlled by the attachment and detachment of struts that are releasably attachable to the back panel at strut back panel attachment sections and releasably attachable to the flexible floor portion at strut floor attachment sections.

In yet another embodiment, the struts comprise strut attachments to releasably attach the struts to the strut back panel attachment sections and strut floor attachment sections.

In yet another embodiment, the strut attachments comprise any one of velcro, hook and loop fasteners, or velcro pile sewn on a polyethylene board.

In yet another embodiment, the strut attachments comprise velcro pile sewn on a polyethylene board.

In yet another embodiment, the struts are semi-rigid.

In yet another embodiment, the struts comprise strut webbing along an upper and lower lateral portion thereof which house strut rods to provide strength to the struts.

In yet another embodiment, the strut rods comprise any one of carbon fibre, pultrusion fiberglass, or pultrusion fiberglass with glass-fibre reinforced polymer or plastic material comprising epoxy, a thermosetting plastic or thermoplastic.

In yet another embodiment, the strut rods comprise pultrusion fiberglass with glass-fibre reinforced with a plastic composite material comprising non-homogeneous thermoplastic resin.

In yet another embodiment, the distal ends of the linear rods comprise end caps fabricated from rubber or injection molded polyethylene plastic.

In yet another embodiment, the first and third rod holders comprise a second opening to releasably and frictionally engage or house the upper distal ends of the first and second removable linear rods.

In yet another embodiment, the lower distal ends of the first and second removable linear rods are releasably engaged or housed by a fabric holder, a webbing holder supported by a rigid support, or an injection molded polyethylene plastic holder.

In yet another embodiment of the present invention, the invention provides a flexible sports bag comprising: a flexible body defining an interior compartment, said body comprising a front panel, a back panel, a top panel, a bottom panel, and first and second side panels; a flexible subframe disposed in the interior compartment to which the flexible body is affixed, said subframe comprising: a first removable linear rod that extends vertically substantially the height of the back panel from a first distal end located proximate a junction of the back panel, the bottom panel and the first side panel to a second distal end located proximate a junction of the back panel, the top panel and the first side panel, and wherein said second distal end is releasably and frictionally engageable with a first end of a first support tube; a second removable linear rod that extends vertically substantially the height of the back panel from a first distal end located proximate a junction of the back panel, the bottom panel and the second side panel to a second distal end located proximate a junction of the back panel, the top panel and the second side panel, and wherein said second distal end is releasably and frictionally engageable with a first end of a second support tube; a first flexible angled rod having a first distal end that is releasably and frictionally engageable with a second end of the first support tube, and that is capable of extending from said second end of the first support tube to a location proximate to a junction of the front panel, the bottom panel and the first side panel where a second distal end of the first flexible angled rod is releasably and frictionally engageable with a first rod holder; and a second flexible angled rod having a first distal end that is releasably and frictionally engageable with a second end of the second support tube, and that is capable of extending from said second end of the second support tube to a location proximate to a junction of the front panel, the bottom panel and the second side panel where a second distal end of the second flexible angled rod is releasably and frictionally engageable with a second rod holder, wherein, when the second distal end of the first removable linear rod is engaged with the first end of the first support tube, the first distal end of the first flexible angled rod is engaged with the second end of the first support tube, and the second distal end of the first flexible angled rod is engaged with the first rod holder, and when the second distal end of the second removable linear rod is engaged with the first end of the second support tube, the first distal end of the second flexible angled rod is engaged with the second end of the second support tube, and the second distal end of the second flexible angled rod is engaged with the second rod holder, the flexible body is maintained in a semi-rigid but semi-compressible state, and wherein, when the first distal end of the first flexible angled rod is disengaged from the second end of the first support tube, and the first distal end of the second flexible angled rod is disengaged from the second end of the second support tube, the first ends of the first and second support tubes are capable of swiveling inward on the second distal ends of the first and second removable linear rods, and whereby said flexible body is compressible for any one or more of storage, transport, shipping or handling.

In yet a further embodiment, the flexible body comprises soft-sided nylon, canvas or polyester.

In yet another embodiment, the first and second removable linear rods are flexible.

In yet another embodiment, the first and second removable linear rods comprise any one of carbon fibre, pultrusion fiberglass, or pultrusion fiberglass with glass-fibre reinforced polymer or plastic material comprising epoxy, a thermosetting plastic or thermoplastic.

In yet another embodiment, the first and second removable linear rods comprise pultrusion fiberglass with glass-fibre reinforced with a plastic composite material comprising non-homogeneous thermoplastic resin.

In yet another embodiment, the first and second removable linear rods are 0.375" in diameter.

In yet another embodiment, the first and second flexible angled rods comprise any one of carbon fibre, pultrusion fiberglass, or pultrusion fiberglass with glass-fibre reinforced polymer or plastic material comprising epoxy, a thermosetting plastic or thermoplastic.

In yet another embodiment, the first and second flexible angled rods comprise pultrusion fiberglass with glass-fibre reinforced with a plastic composite material comprising non-homogeneous thermoplastic resin.

In yet another embodiment, the first and second flexible angled rods are 0.25" to 0.27" in diameter.

In yet another embodiment, the first and second rod holders comprise an opening section to releasably and frictionally engage or house the second distal ends of the first and second flexible angled rods.

In yet another embodiment, the first and second rod holders comprise an opening that is tapered.

In yet another embodiment, the rod holders are fabricated from plastic, fabric, metal, or synthetic plastic material.

In yet another embodiment, the rod holders are fabricated from injection molded polyethylene plastic.

In yet another embodiment, the rod holders are engaged with the first and second side panels by riveting said side panels to a plastic board.

In yet another embodiment, the bottom panel further comprises a flexible floor portion that is vertically foldable along a lateral length of said bottom panel to increase the compressibility of the sports bag.

In yet another embodiment, the first distal ends of the first and second removable linear rods comprise end caps fabricated from rubber or injection molded polyethylene plastic.

In yet another embodiment, the first distal ends of the first and second removable linear rods are releasably engaged or housed by a fabric holder, a webbing holder supported by a rigid support, or an injection molded polyethylene plastic holder.

These and other objects and features of this invention will become more apparent upon reference to the following detailed description of preferred embodiments as illustrated in the accompanying drawings.

BRIEF SUMMARY OF THE DRAWINGS

The accompanying drawings illustrate preferred embodiments of the invention by way of example, and, together with the description, serve to explain the principles of the invention as well as the best mode in which the inventor contemplates applying them. Similar numbers refer to similar parts throughout the drawings.

DETAILED DESCRIPTION OF THE INVENTION

A detailed description of various illustrative embodiments and possible implementations of the present invention will now be provided. It should be appreciated that the present invention contains elements and features that can be implemented in a wide variety of ways. Although the invention will be described in connection with specific preferred embodiments, the embodiments described, and the specific details of those embodiments as will be provided in the following pages, are purely exemplary and do not limit the scope of the present invention as claimed. The invention extends to alternatives, modifications, and equivalents to each of its elements, all of which are included in the scope of the invention. Various modifications and variations of the described systems and methods of the invention will be apparent to those skilled in the art without departing from the scope and spirit of the invention. As well, alternative uses may be made of the present invention without departing from its scope. Furthermore, certain terms have been used for brevity, clarity, and understanding. No unnecessary limitations are to be implied therefrom because such terms are used for descriptive purposes and are intended to be broadly construed.

Figure 1:
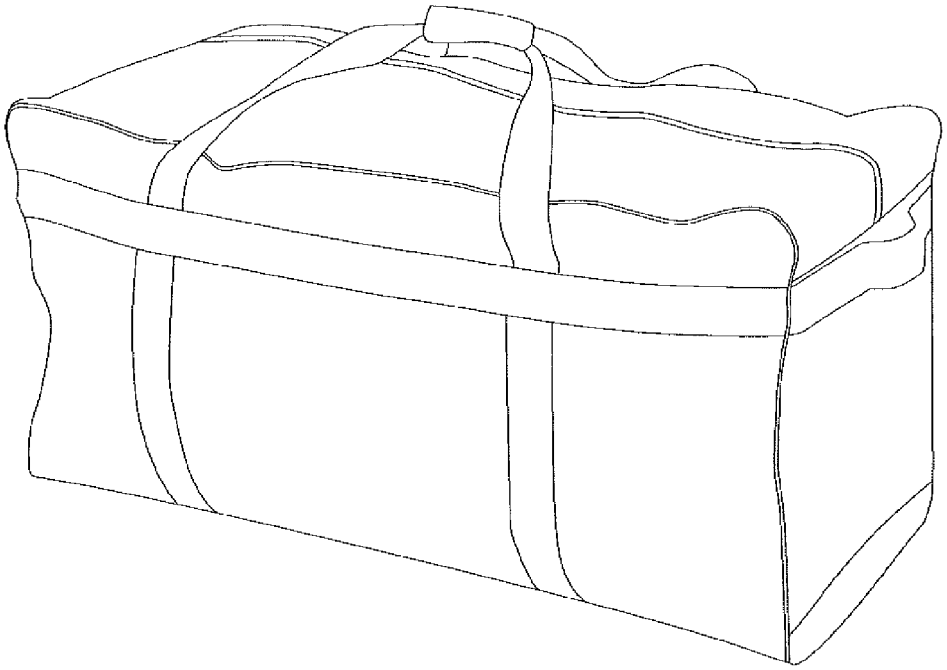
FIG. 1 shows prior art "duffle bag" type sports equipment bags.
Figure 2:
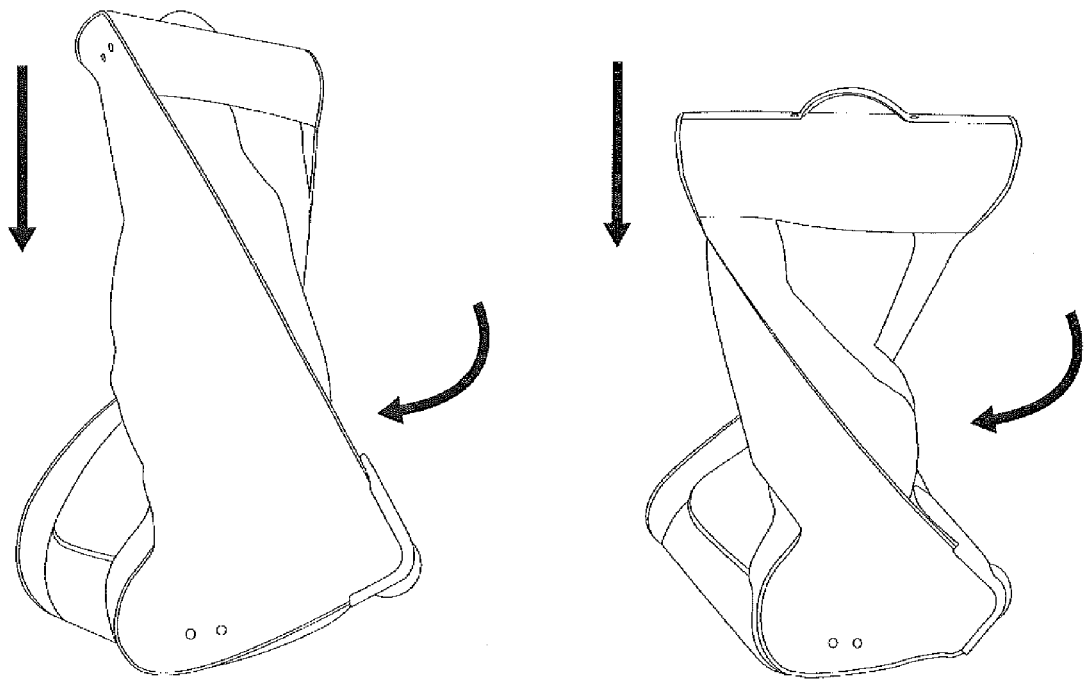
FIG. 2 shows a sports equipment bag with Torsion Technology™ undergoing compression tests.

The present invention improves upon prior-art rigid sports bags by, for one, replacing the traditional steel and plastic construction primarily used in such bags with Torsion Technology™, disclosed herein, to provide a novel sports equipment bag with flexibility, durability, strength, and a net weight reduction. In particular, the Torsion Technology™ integrates optionally removable composite rods into the frame structure of a sports bag to allow for significant flexibility and compression thereof. As an example, FIG. 2 shows a sports equipment bag with Torsion Technology™ undergoing compression tests exceeding 7500 lbs of pressure. After testing the bag returned to its original shape. This demonstrates that the sports bags of the present invention are thereby more flexible and collapsible than prior-art sports bags for general transport, storage, shipping and handling purposes, and yet are also capable of holding a semi-rigid exterior to a given volume and shape when in regular use. The present invention also discloses a sports equipment bag with a novel folding floor to assist with the flexible and collapsible nature of a sports equipment bag. Such a folding floor may optionally be provided in a sports bag that also employs Torsion Technology™. In such a case, it is preferable that the sports bag utilizes removable composite rods in the frame structure.

Figure 3:
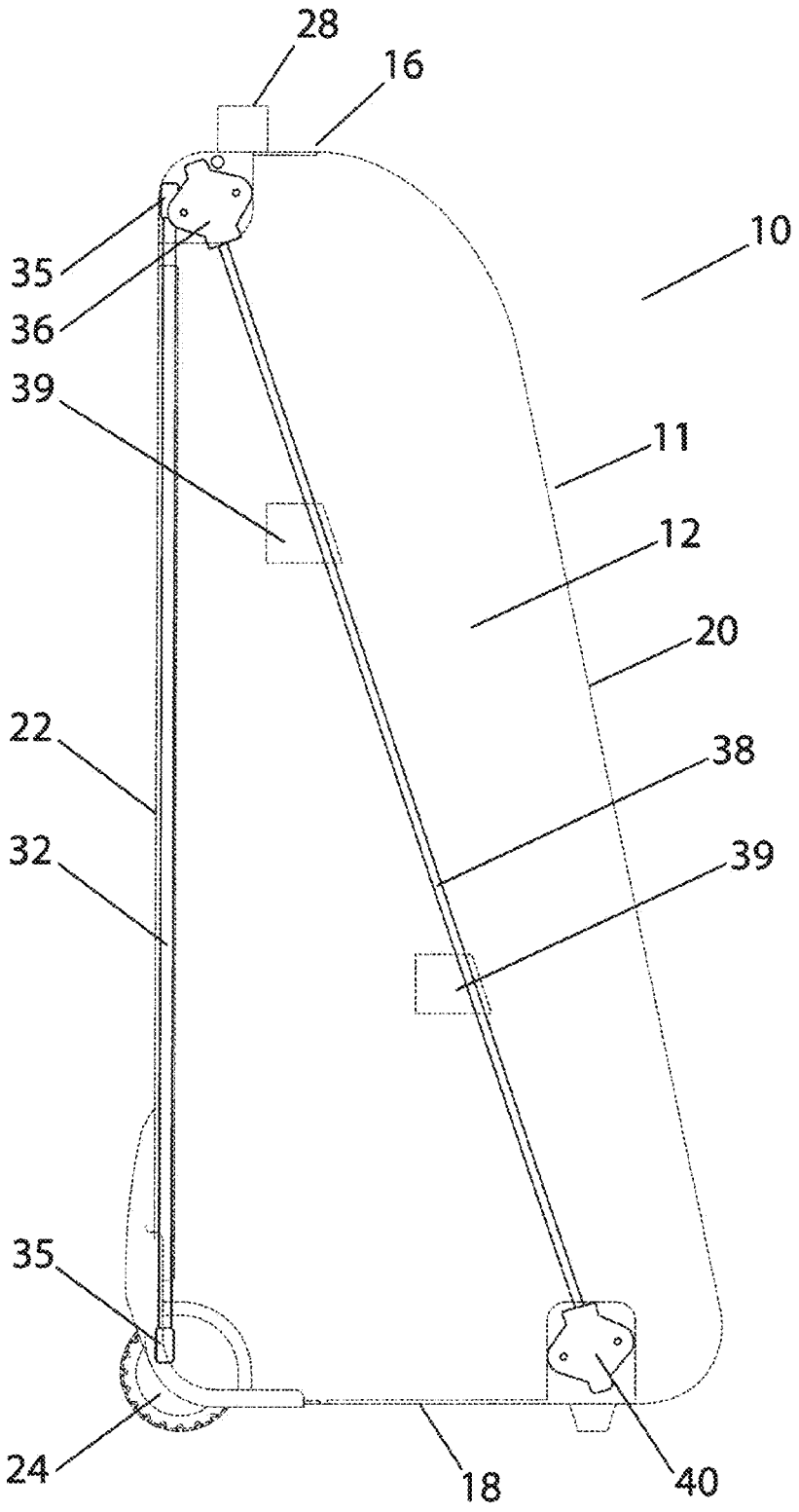
FIG. 3 is a side elevation view of a first embodiment of the sports bag of the present invention.
Figure 4:
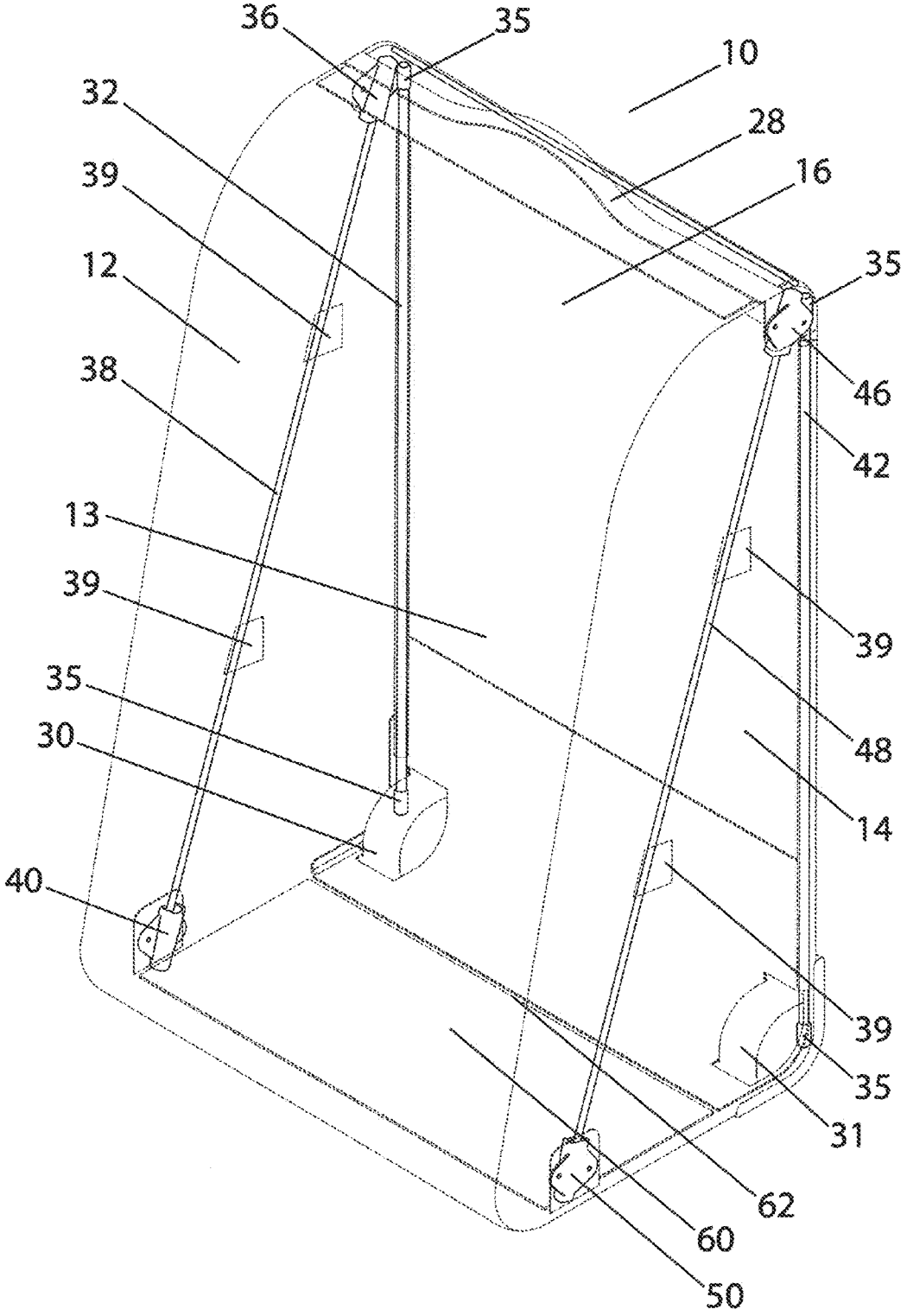
FIG. 4 is a perspective view of the first embodiment of the sports bag of the present invention.

FIGS. 3 and 4 show a side elevation and perspective view, respectively, of an embodiment of the flexible sports bag 10 of the present invention. The exterior structure of sports bag 10 comprises: two side panels 12 and 14 (side panel 12 is facing the viewer in FIG. 3, while side panel 14 is on the opposite side of sports bag 10 and is seen in FIG. 4); top panel 16; bottom panel 18; front panel 20; and back panel 22. In FIGS. 3 and 4, sports bag 10 is shown in a generally tapered configuration, and more particularly in the shape of Grit's hockey bag distinguishing Guise™. However, it is understood that the sports bag may be of almost any desired shape, and the invention would still be applicable thereto. The general exterior 11 of sports bag 10, as shown in dotted outline, may be made of any material providing a resilient yet yielding fabric. In this respect, soft-sided nylon, canvas or polyester are preferable embodiments, and nylon or polyester are especially preferred because of their water resistant properties. The interior of sports bag 10 (generally referred to as 13 in FIG. 4) may be accessed by an ingress means (not shown), such as a panel or door, such as a zippered door, that resealably opens and closes, and normally comprises a portion of the exterior 11 on front panel 20. A person skilled in the art would appreciate that any convenient and recloseable fastening means can serve to allow the ingress means to be opened and closed. For instance, such fastening means can be any means which allows the ingress means, the panel or door, for example, to be opened and closed conveniently by the user, including zippers, hook and loop fasteners, buckles, snaps, hook and eye fasteners, and similar means known to the person of ordinary skill in the art. Preferred embodiments include hook and loop fasteners and zippers. Especially preferred are zippers. The rearward portion of the junction between bottom panel 18 and back panel 22 may include wheels 24 and 26 (wheel 24 is seen in FIG. 3, while wheel 26 is located on the opposite side) contained within wheel wells 30 and 31 on either end of sports bag 10, although these wheels and wheel wells are optional and not necessary to the functioning of the present embodiment of the invention, or to the invention in general. Top panel 16 is also shown with handle 28 extending upwards therefrom, although this element is optional as well. In addition, a linear composite rod generally the width of the sports bag may be employed from a location in the interior of the sports bag 10 under top panel 16 proximate side panel 12 to side panel 14 to provide additional horizontal strength to the supports bag if desired, but this element is not necessary to the invention in general.

Figure 5A:
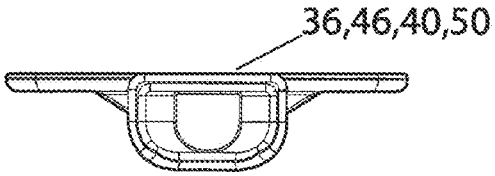
FIGS. 5*a* to 5*e* shows various views of a preferred embodiment of a holder of the present invention.
Figure 5B:
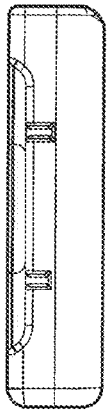
Figure 5C:
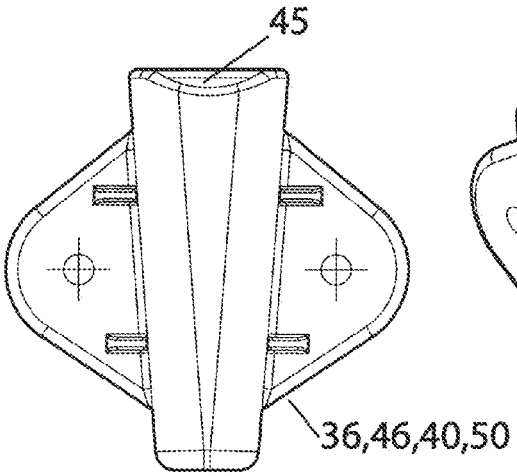
Figure 5D:
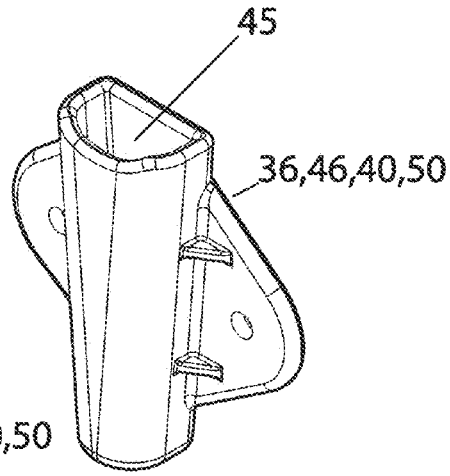
Figure 5E:
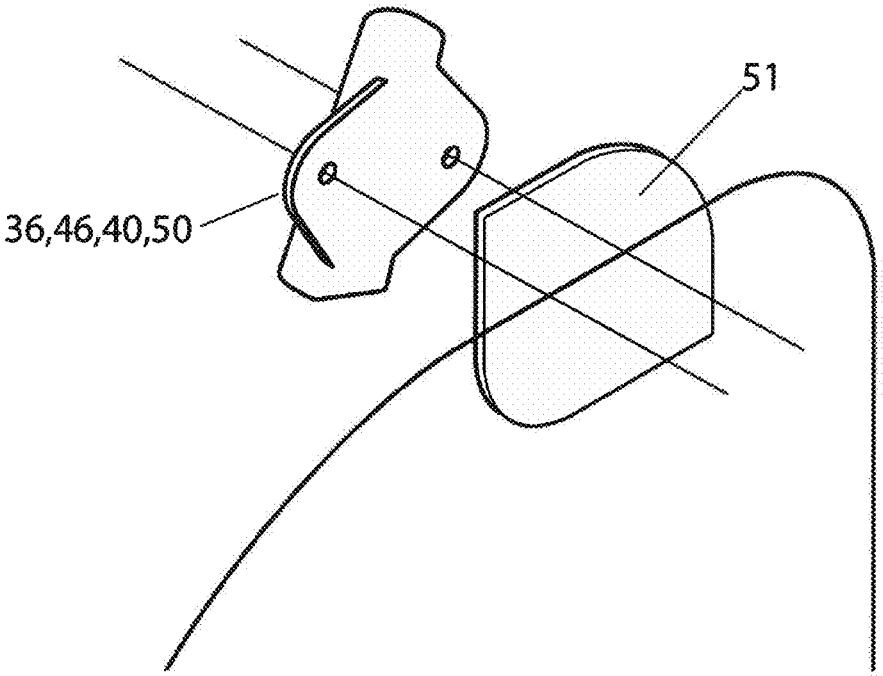
Figure 16:
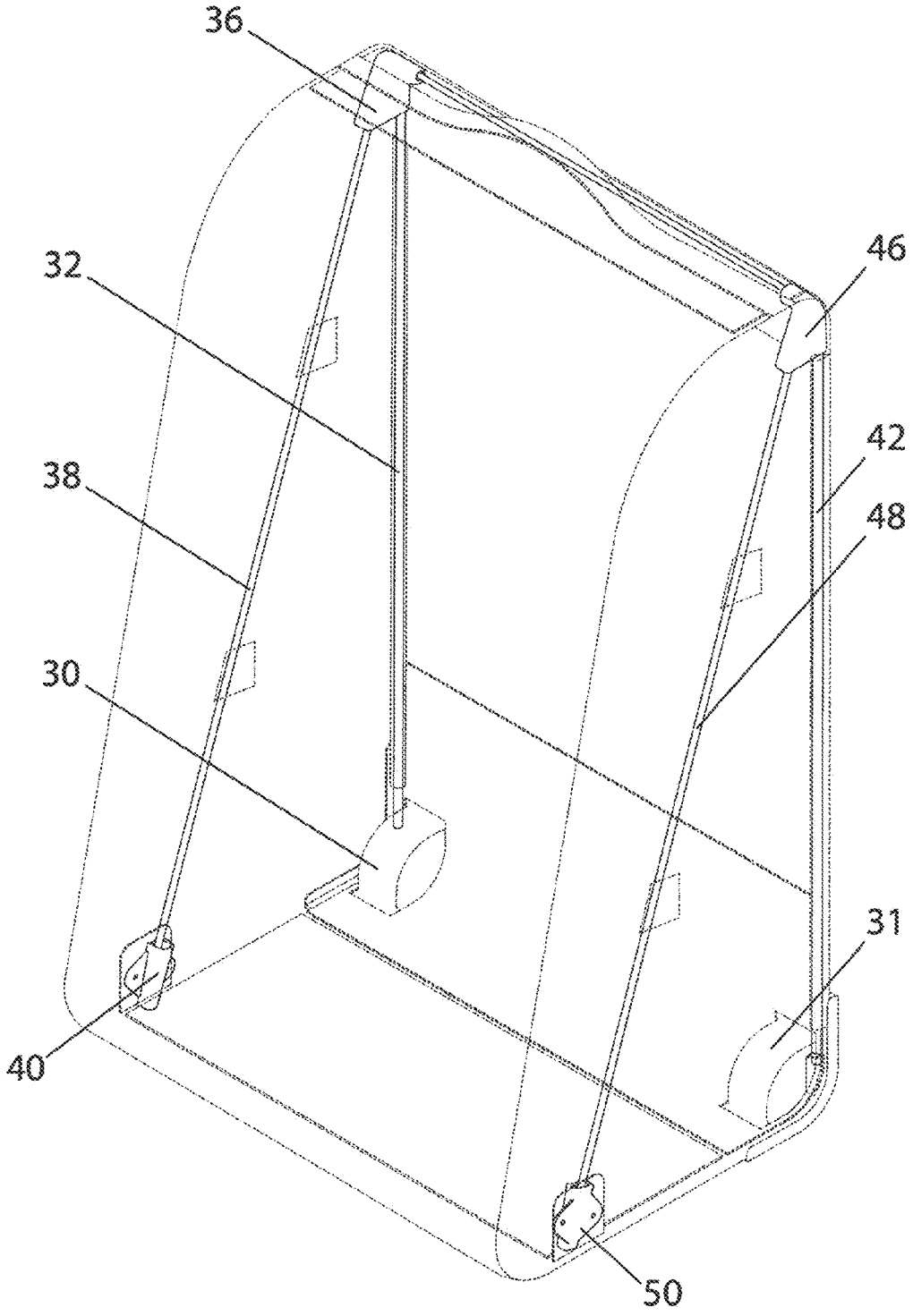
FIG. 16 is a perspective view of a fifth embodiment of the sports bag of the present invention.

The Torsion Technology™ aspects of the present invention are implemented by the use of specially designed holders and rods. With reference to FIGS. 3 and 4, linear rods 32 and 42 extend vertically substantially the height of back panel 22. In particular, linear rods 32 and 42 extend vertically from a location proximate wheel wells 30 and 31 (or, where sports bag 10 does not have wheel wells and associated wheels, from a location proximate opposing ends of the junction of side panels 12 and 14, bottom panel 18, and back panel 22) to locations proximate opposing ends of the junction of top panel 16, back panel 22, and side panels 12 and 14 respectively. Linear rods 32 and 42 may be made of rigid carbon fibre or fiberglass to provide sports bag 10 with a more rigid back, and may be housed in a webbing sleeve or the like (not shown) against the interior side of back panel 22, or linear rods 32 and 42 may be made of a more flexible composite material to allow for much greater flexion (which allows for greater compression characteristics like that seen in FIG. 2). Such composite material may comprise, for example, flexible carbon fibre or pultrusion fiberglass, and preferably pultrusion fiberglass with glass-fibre reinforced polymer or plastic material comprising epoxy, a thermosetting plastic (such as polyester or vinylester) or thermoplastic. More specifically, it has been found that the use of a composite rod comprising pultrusion fiberglass with glass-fibre reinforced with a plastic composite material comprising non-homogeneous thermoplastic resin is especially preferred, in that it provides the sports bag 10 with beneficial flexibility, durability, strength, and a net weight reduction (it has a high strength-to-weight ratio, long service life, and is also slip and impact resistant, and easy to install and fabricate). Moreover, it has been found that the especially preferred composition is also generally waterproof, has anti-corrosion qualities, and does not possess magnetic properties, which allows it to replace metal materials in an electromagnetic environment. The rigidity of linear rods 32 and 42 can also be adjusted as needed by not only modifying the composite materials used, but also the thickness of the rod (or diameter, where a rod is cylindrical, as the term "rod" herein encompasses non-cylindrical shapes; it being understood that non-cylindrical shaped rods may not have flexibility in all axes—a property that may be desired to those skilled in the art to restrict the flexibility of the bag to specific axes and dimensions), and in this manner with known fabrication techniques the person of skill in the art can fabricate linear rods 32 and 42 having the desired level of rigidity and flexibility. In this respect, it has been found that an optimal diameter for linear rods 32 and 42 of the especially preferred composition is 0.375". Thinner linear rods often make the sports bag too flexible, while thicker rods make the sports bag too rigid. In addition, such rods may be made hollow to modify rigidity and decrease weight, especially in relation to cylindrical rods. Linear rods 32 and 42 may utilize end caps 35 (made of any suitable protective material including rubber, injection molded PE plastic, and similar compositions) at their distal or terminal ends in order to protect the sports bag 10 from wear or damage at the point where the ends of these linear rods engage the interior surface of the bag. Alternatively, holders 36 and 46, described below (and optionally similar holders that could be placed at a location proximate opposing ends of the bottom rear end sections of the interior of the sports bag 10) may be made to engage and house the terminal ends of linear rods 32 and 42, respectively, to provide similar protection and stability. In this respect, holders 36 and 46 may also be fabricated so as to comprise two slots or openings to engage or house the terminal ends of linear rods 32 and 42, respectively, as well as angled rods 38 and 48, respectively (as shown in FIG. 16). Angled rods 38 and 48 are housed or preferably releasably engageable with holders 36 and 46 located proximate opposing ends of the junction of top panel 16, back panel 22, and side panels 12 and 14 respectively, and, when employed in the normal course to provide structure to the sports bag 10 extend generally diagonally proximate side panels 12 and 14 until they are housed or engaged with mated and corresponding holders 40 and 50, which are located proximate opposing ends of the junction of front panel 20, bottom panel 18, and side panels 12 and 14 respectively. Angled rods 38 and 48 may be made of a flexible carbon fibre or composite material to provide sufficient flexion (which allows for greater compression characteristics like that seen in FIG. 2), and more particularly may comprise, for example, pultrusion fiberglass, and preferably pultrusion fiberglass with glass-fibre reinforced polymer or plastic material comprising epoxy, a thermosetting plastic (such as polyester or vinylester) or thermoplastic. More specifically, it has been found that the use of a composite rod comprising pultrusion fiberglass with glass-fibre reinforced with a plastic composite material comprising non-homogeneous thermoplastic resin is especially preferred, in that it provides the sports bag 10 with beneficial flexibility, durability, strength, and a net weight reduction (it has a high strength-to-weight ratio, long service life, and is also slip and impact resistant, and easy to install and fabricate). Moreover, it has been found that the especially preferred composition is also generally waterproof, has anti-corrosion qualities, and does not possess magnetic properties, which allows it to replace metal materials in an electromagnetic environment. The rigidity of angled rods 38 and 48 can also be adjusted as needed by not only modifying the composite materials used, but also the thickness of the rod (or diameter, where a rod is cylindrical, as the term "rod" herein encompasses non-cylindrical shapes as discussed above; it being understood that non-cylindrical shaped rods may not have flexibility in all axes—a property that may be desired to those skilled in the art to restrict the flexibility of the bag to specific axes and dimensions), and in this manner with known fabrication techniques the person of skill in the art can fabricate angled rods 38 and 48 having the desired level of rigidity and flexibility. In this respect, it has been found that an optimal diameter for angled rods 38 and 48 of the especially preferred composition is 0.25" to 0.27". Thinner linear rods often make the sports bag too flexible, while thicker rods make the sports bag too rigid. In addition, such rods may be made hollow to modify rigidity and decrease weight, especially in relation to cylindrical rods. Optionally, and as shown in FIGS. 3 and 4, angled rods 38 and 48 may also be engaged with, or pass through, side attachments 39, which are affixed to the interior of side panels 12 and 14, and which assist in holding the angled rods 38 and 48 against or proximate to the interior of side panels 12 and 14 respectively. The side attachments 39 may comprise velcro attachments, loops of fabric stitched to side panels 12 and 14, U-shaped portions of plastic stitched or riveted to side panels 12 and 14, or any other similar means and materials. Holders 36 and 46, as well as mated and corresponding holders 40 and 50, are fabricated so as to releasably receive or house a distal end of one of angled rods 38 or 48 respectively in such a manner so as to provide structure and hold the sports bag in a flexible, yet semi-rigid state. Holders 36 and 46 may also be made to further releasably receive or house a distal end of linear rods 32 and 42 respectively, as mentioned above (and as shown in FIG. 16). A preferred embodiment of holders 36 and 46, and mated and corresponding holders 40 and 50, is shown at FIGS. 5*a* to 5*e*. Holders 36, 46, 40, and 50 may be fabricated from plastic, fabric, metal, or synthetic materials, such as synthetic plastic material (e.g. polypropylene, polyurethane, and polyethylene), and may be injection molded. In a preferred embodiment, holders 36, 46, 40, and 50 are comprised of injection molded PE plastic, and are engaged with side panels 12 and 14 by riveting them to a plastic board 51, as shown in FIG. 5*e*. Alternatively, holders 36, 46, 40, and 50 may be secured to the sports bag 10 in any other known fashion that allows them to be securely fastened, such as, for example, by means of stitching, glue, or any other means known to the person of ordinary skill in the art. The holders 36, 46, 40, and 50 comprise an opening section 45 to releasably and frictionally engage or house the distal ends of the appropriate rods, preferably an opening section 45 that is tapered (as specifically shown in FIGS. 5*c* and 5*d*), although tapering is not necessary, and other alternative mechanisms for frictionally engaging the appropriate rods are possible and would be known to the person of skill in the art.

Figure 6:
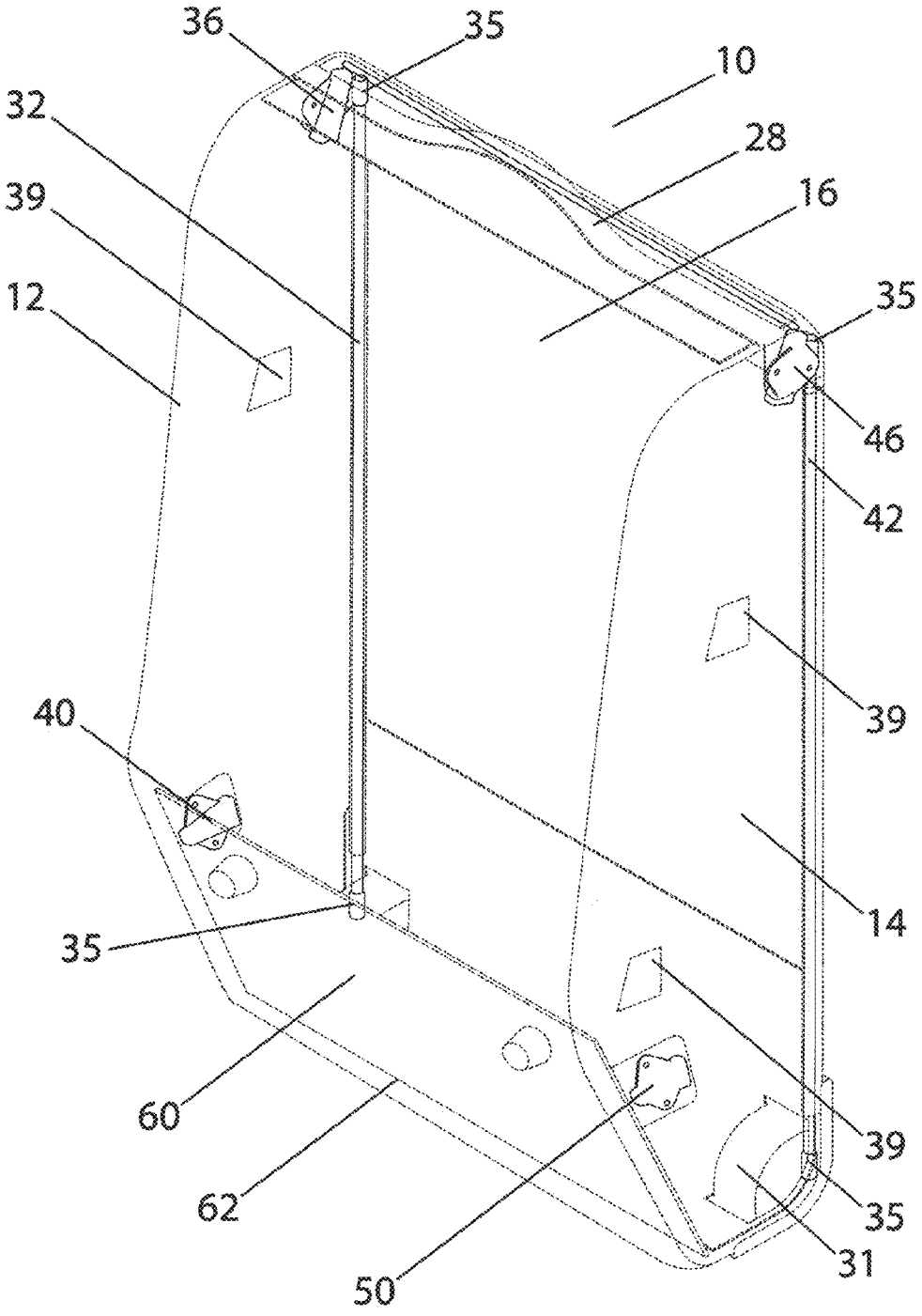
FIG. 6 is a perspective view of the first embodiment of the sports bag of the present invention with angled rods removed and showing collapsibility of the floor.

FIG. 4 also partially shows another aspect of the present invention that may be present in a sports bag that employs the Torsion Technology™ described above, namely a folding floor to assist with the flexible and collapsible nature of a sports equipment bag. In this respect, FIG. 4 shows bottom panel 18 of the sports bag 10 which optionally comprises a flexible floor portion 60 that may be made of plywood, preferably plywood sewn into a 600D polyester floor material (or any material similar in effect to plywood that provides a rigid and durable floor portion), and that is vertically foldable along a lateral length 62 of bottom panel 18 (as demonstrated in FIG. 6). The flexible floor portion 60 may be attached to the lateral length 62 of the bottom panel 18 by any appropriate flexion means, such as by sewing the floor portion 60 into the polyester floor material with a sewn seam. One can appreciate, and as shown in FIG. 6, that the folding floor portion 60 can be more readily folded/flexed when the angled rods 38 and 48 have been releasably removed from holders 36, 46, and 40 and 50, respectively, although significant folding may still be achieved with the rods in place if the rods comprise a suitable composite material and diameter.

Figure 7:
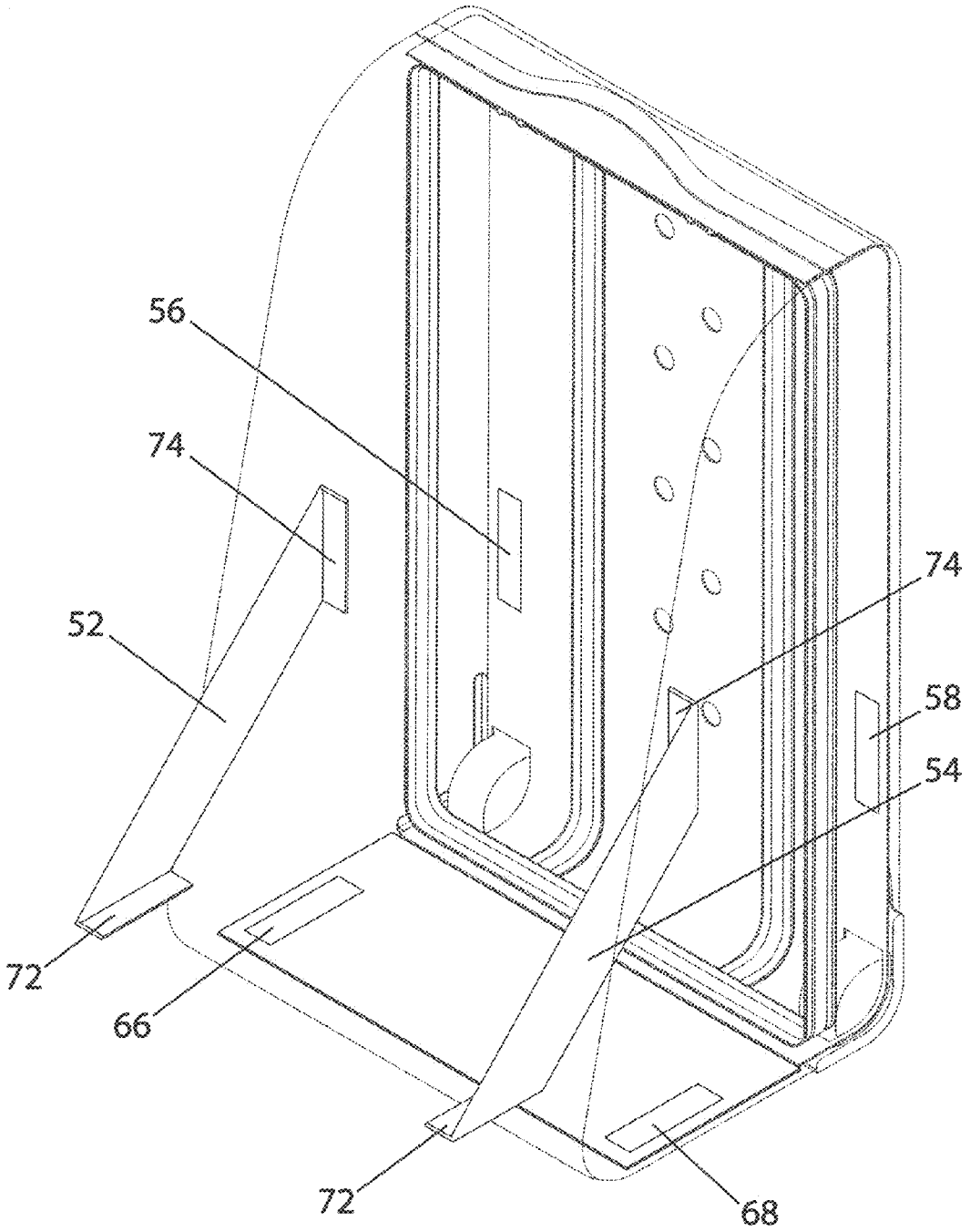
FIG. 7 is a perspective view of a second embodiment of the sports bag of the present invention showing struts that assist with floor collapsibility.
Figure 8:
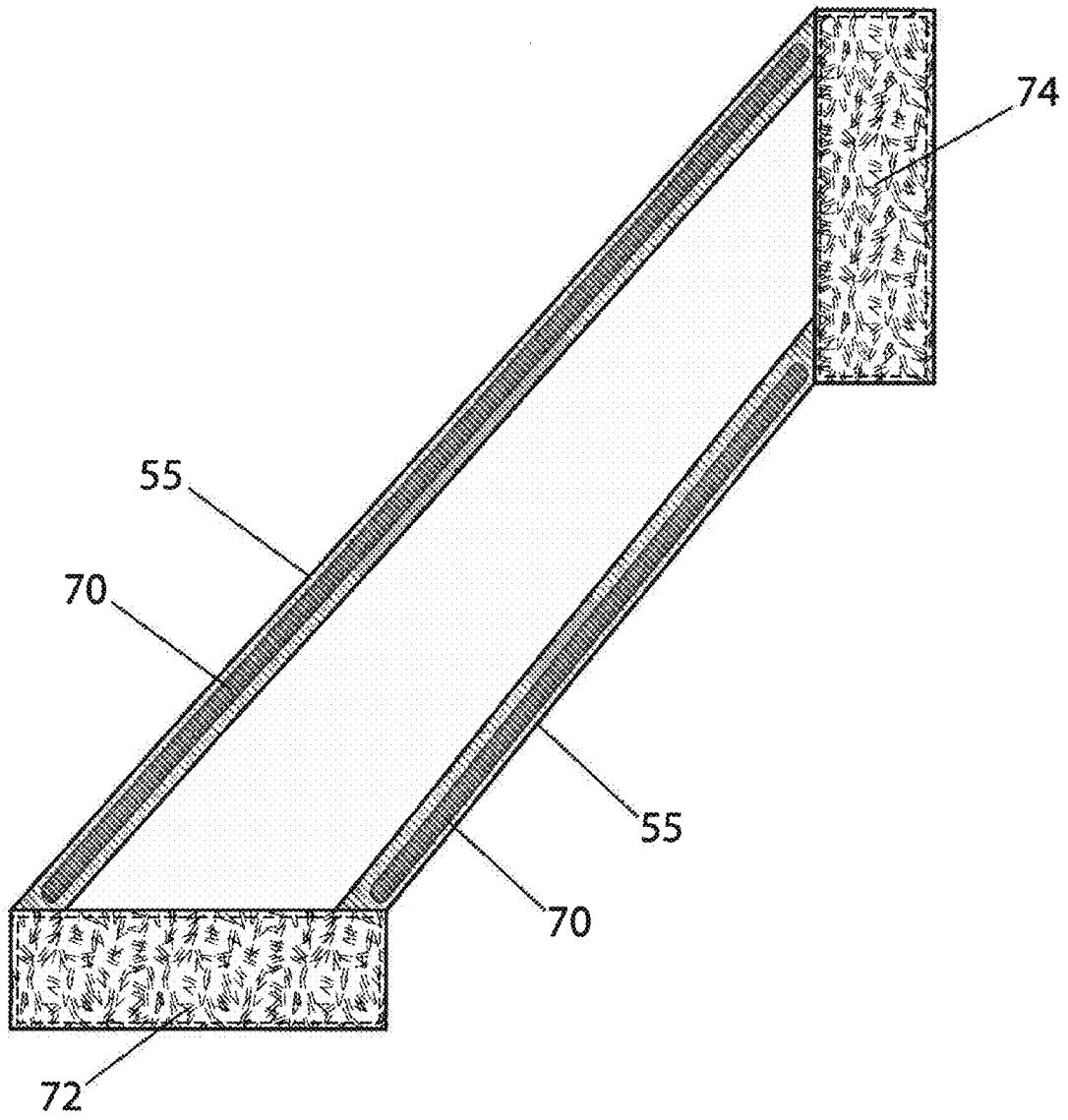
FIG. 8 is a side plan view of an embodiment of the struts that assist with floor collapsibility.
Figure 9:
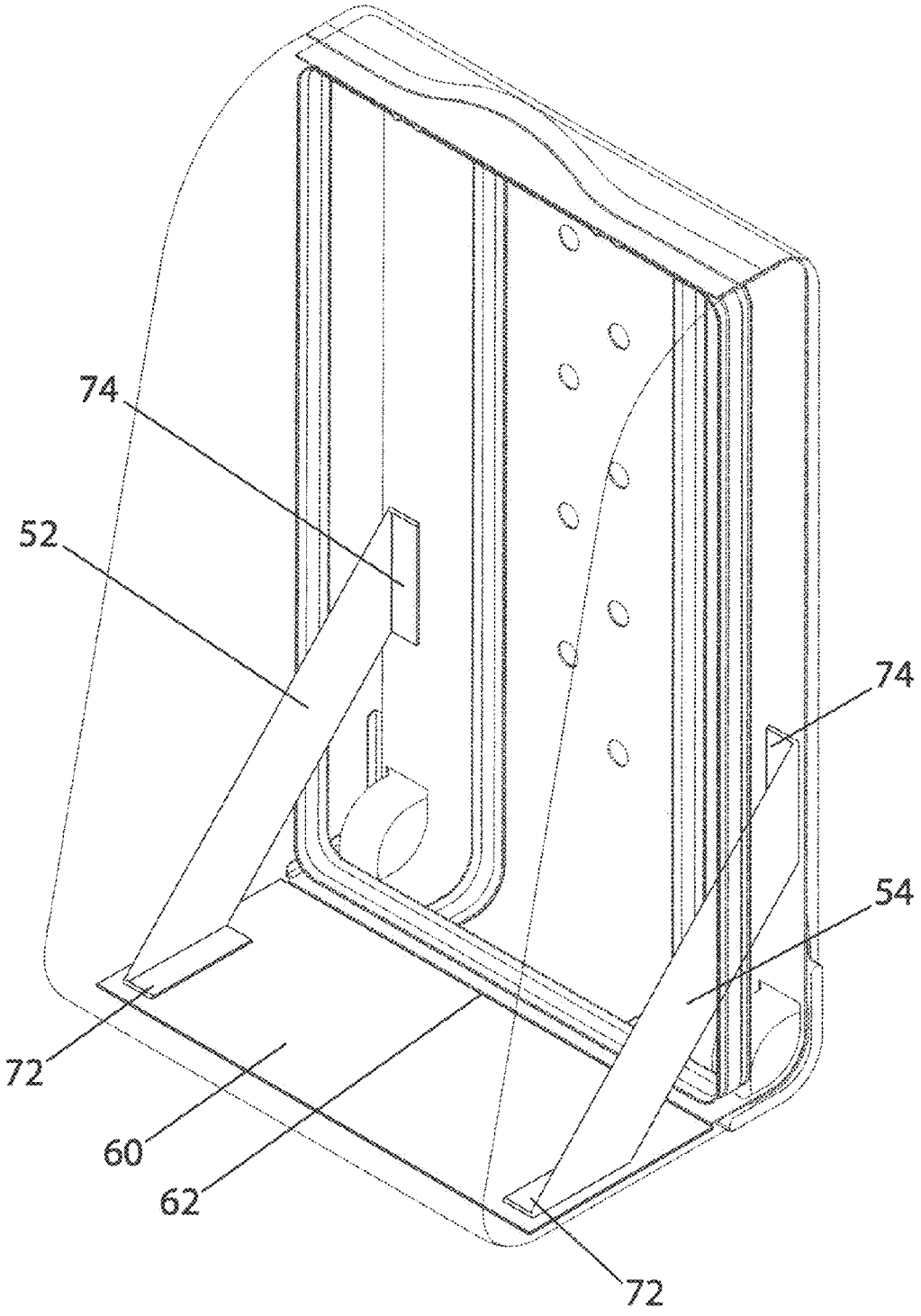
FIG. 9 is a perspective view of the second embodiment of the sports bag of the present invention wherein the struts are attached to the bottom panel and back panel respectively.
Figure 10:
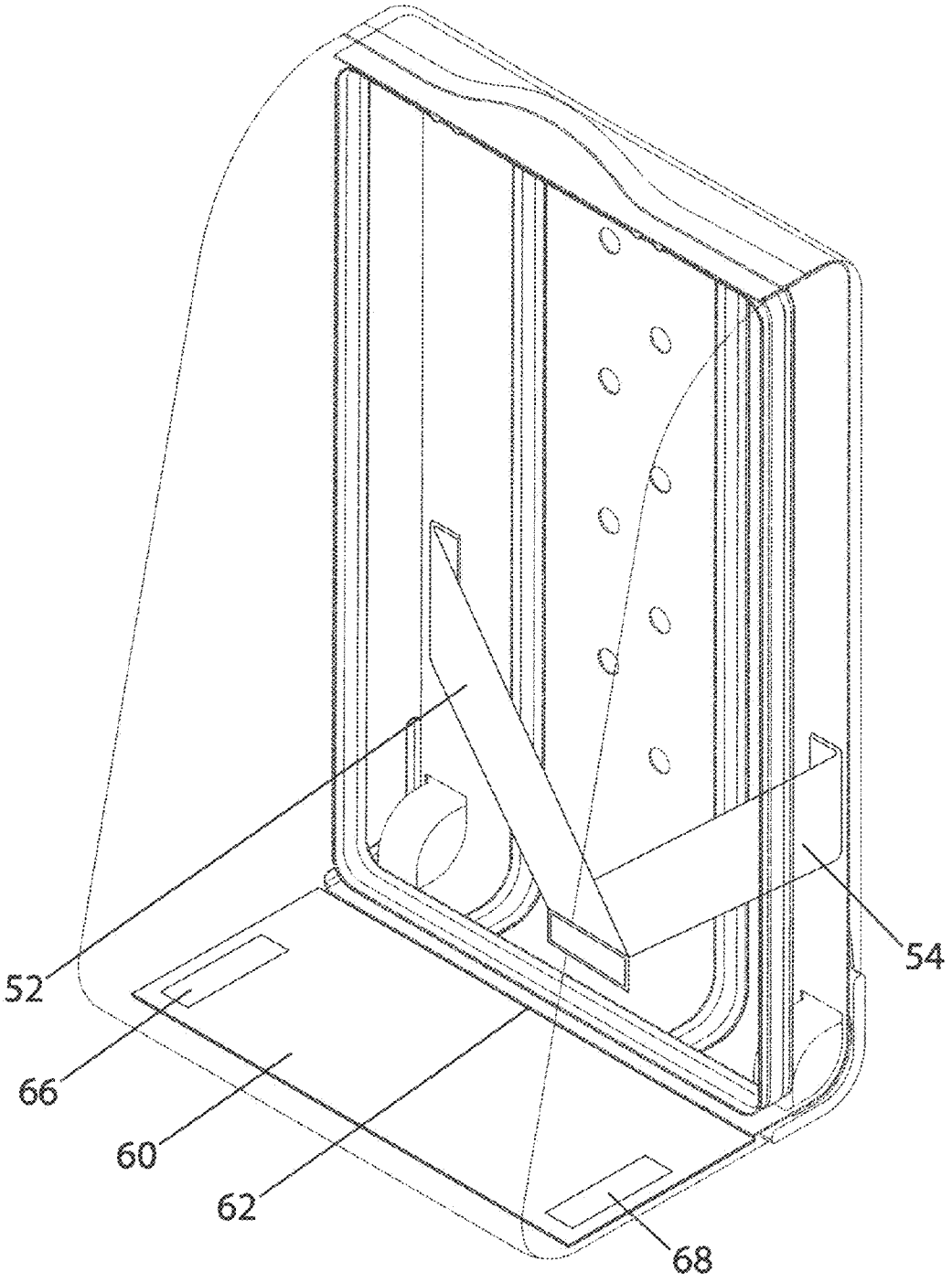
FIG. 10 is a perspective view of the second embodiment of the sports bag of the present invention wherein the struts are attached only to the back panel.
Figure 11:
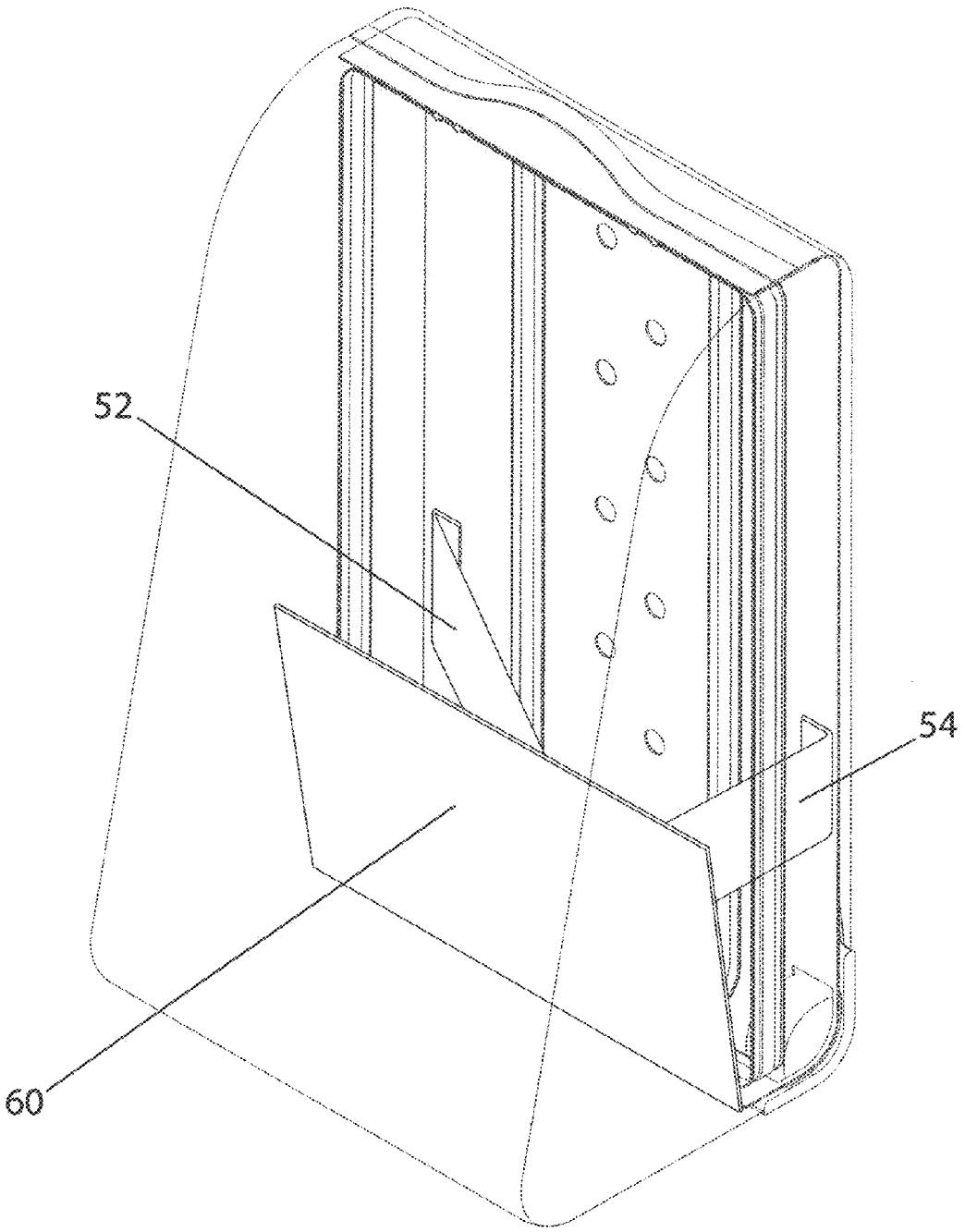
FIG. 11 is a perspective view of the second embodiment of the sports bag of the present invention wherein the struts are attached only to the back panel and the bottom panel is in a folded position.

FIG. 7 shows another embodiment of the present invention, wherein vertical folding of the flexible floor portion 60 along a lateral length 62 of the bottom panel 18 is controlled by the attachment or detachment of struts 52 and 54, which are optionally releasably attachable to strut back panel attachment sections 56 and 58 at locations on the back panel 22, and further optionally releasably attachable to strut floor attachment sections 66 and 68 on flexible floor portion 60. A preferred embodiment of a strut 52 or 54 is shown in FIG. 8. As can be seen, the struts 52 and 54 are preferably semi-rigid, preferably comprising polyester or similar material, and preferably include strut webbing 55 along an upper and lower lateral portion thereof, to support and/or house strut rods 70, which may be made of any composition, preferably composite rods, to provide strength to struts 52 and 54 in order to generally maintain their shape. Such strut rods 70 may optionally be made of the same material as the linear rods 32 and 42 or angled rods 38 and 48. Struts 52 and 54 also comprise, at each distal end thereof, strut attachments 72 and 74 that preferably comprise velcro, hook and loop fasteners or similar material, and especially comprise a velcro pile sewn on a PE board that is attachable to the strut back panel attachment sections 56 and 58 and strut floor attachment sections 66 and 68, respectively. A person skilled in the art will appreciate that any suitable method of adhering the strut attachments to the strut back panel attachment sections 56 and 58 and strut floor attachment sections 66 and 68 could be utilized, including, but not limited to glue, tape, tab and slot attachment systems, and hook and fastener systems, with those attachment means preferably being releasably removable attachment means so as to allow for easy removal and re-attachment of the struts 52 and 54 to the back panel 22 and flexible floor portion 60. FIG. 9 shows the same embodiment of the invention as shown in FIG. 7, except the struts 52 and 54 appear in an assembled or attached state. FIG. 10 shows the same embodiment of the invention as shown in FIGS. 7 and 9, except strut attachments 72 have been detached from the strut floor attachment sections 66 and 68, and the flexible floor portion 60 is ready to be vertically folded up to assist in compressing or collapsing the sports bag 10. FIG. 11 shows the flexible floor portion 60 in a vertically folded position, with struts 52 and 54 folded across the interior of the bag.

Figure 12:
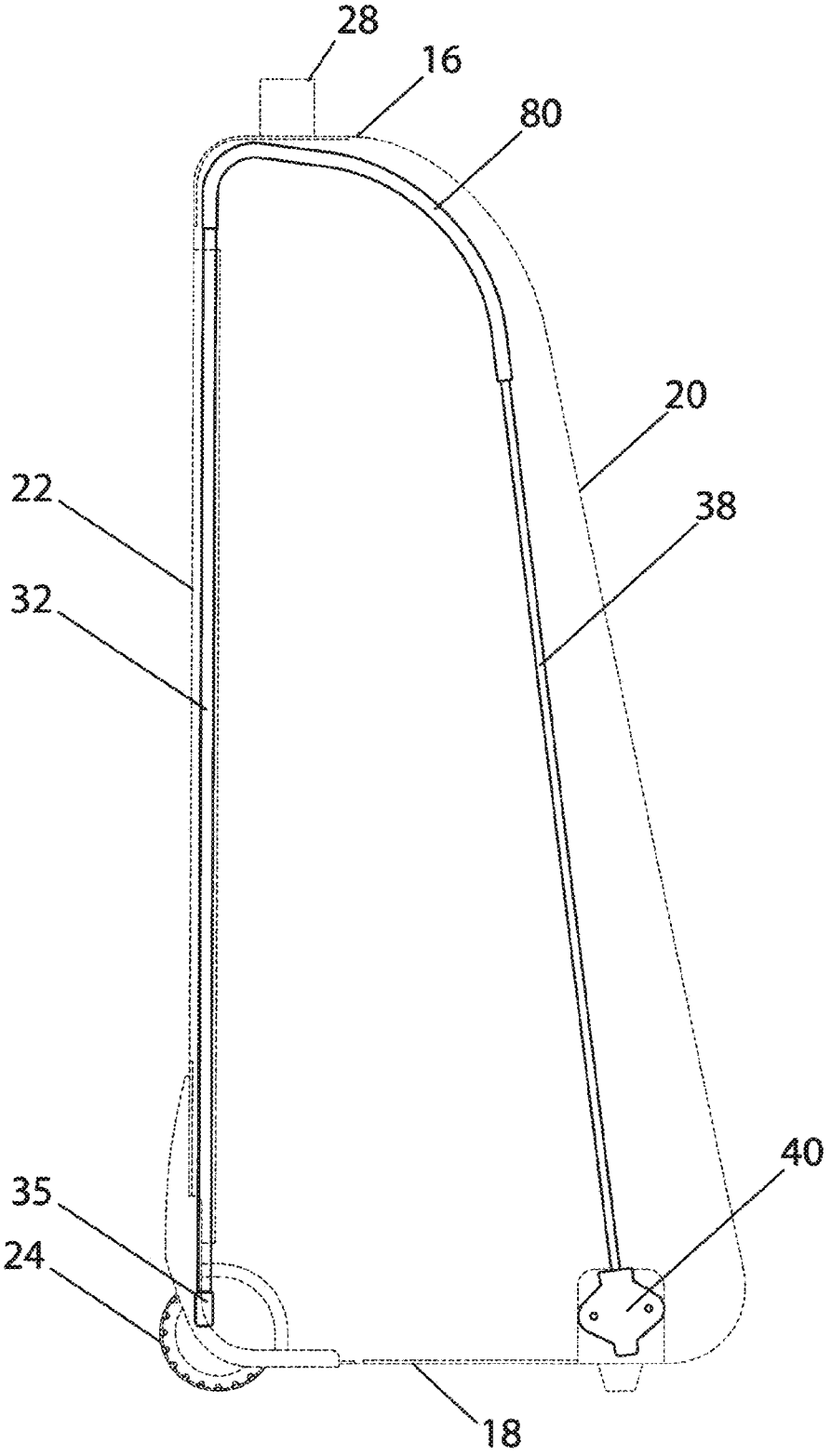
FIG. 12 is a side elevation view of a third embodiment of the sports bag of the present invention.
Figure 13:
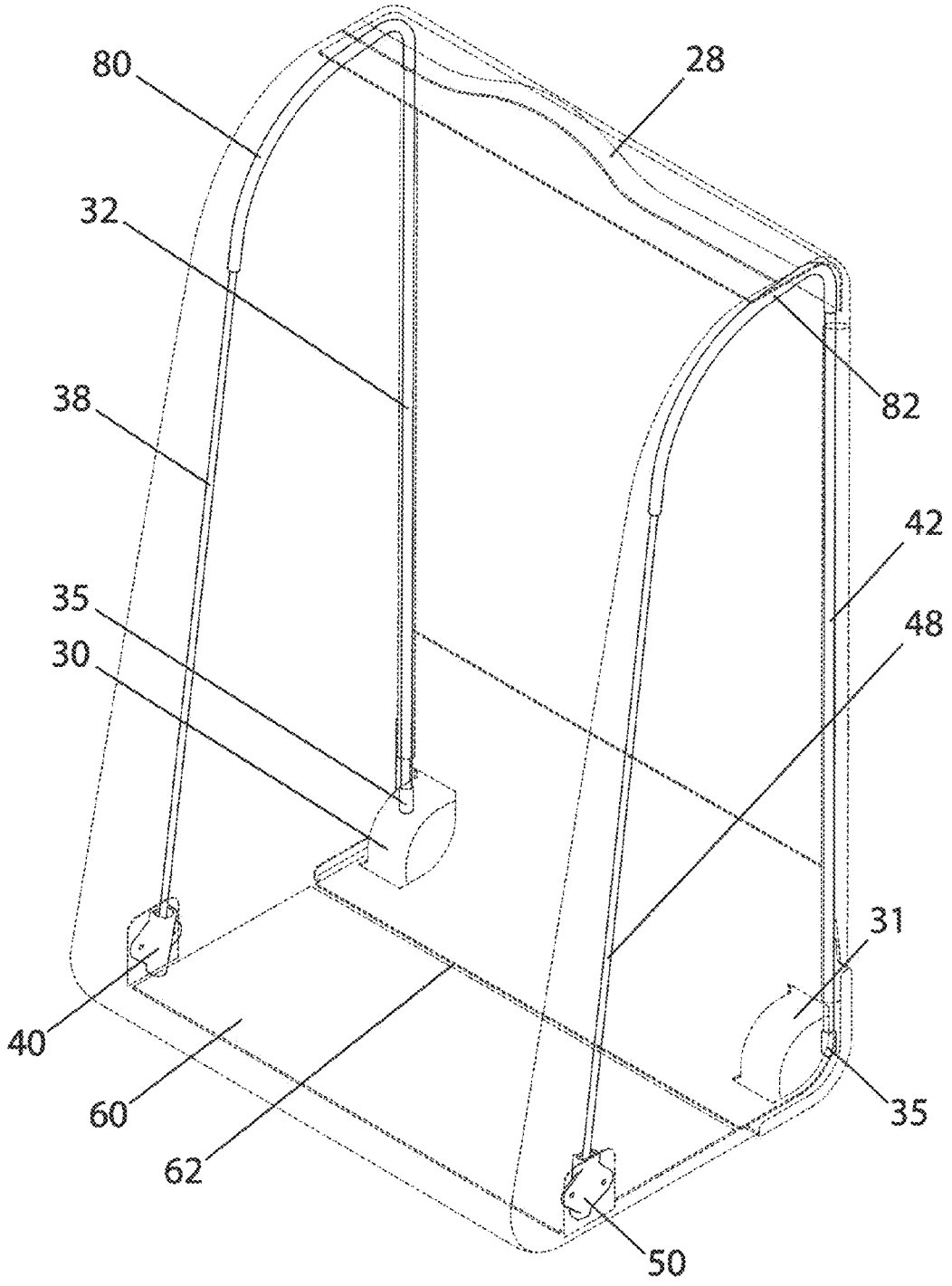
FIG. 13 is a perspective view of the third embodiment of the sports bag of the present invention.

FIGS. 12 and 13 show yet another embodiment of the present invention, wherein holders 36 and 46 have been effectively replaced by tubes 80 and 82. Tubes 80 and 82 may be made of rigid fiberglass, plastic or composite material, for example, but are preferably made of steel or similarly strong material to provide support for when heavier items, such as goalie pads, are to be hung on the sports bag 10. One distal end of tubes 80 and 82 are sufficiently wide enough to releasably and frictionally engage or house linear rods 32 and 42, while the opposing distal ends of tubes 80 and 82 are sufficiently wide to releasably and frictionally engage or house shorter angled rods 38 and 48 (which are themselves releasably engageable with mated and corresponding holders 40 and 50 at their other distal end). When the shorter angled rods 38 and 48 are disengaged or removed, the tubes 80 and 82 are able to swivel on the upper distal end of linear rods 32 and 42 towards the interior centre of the sports bag 10 for folding and compression purposes, and the flexible floor portion 60 is more readily able to vertically fold to assist with such folding and compression of the sports bag 10.

Figure 14:
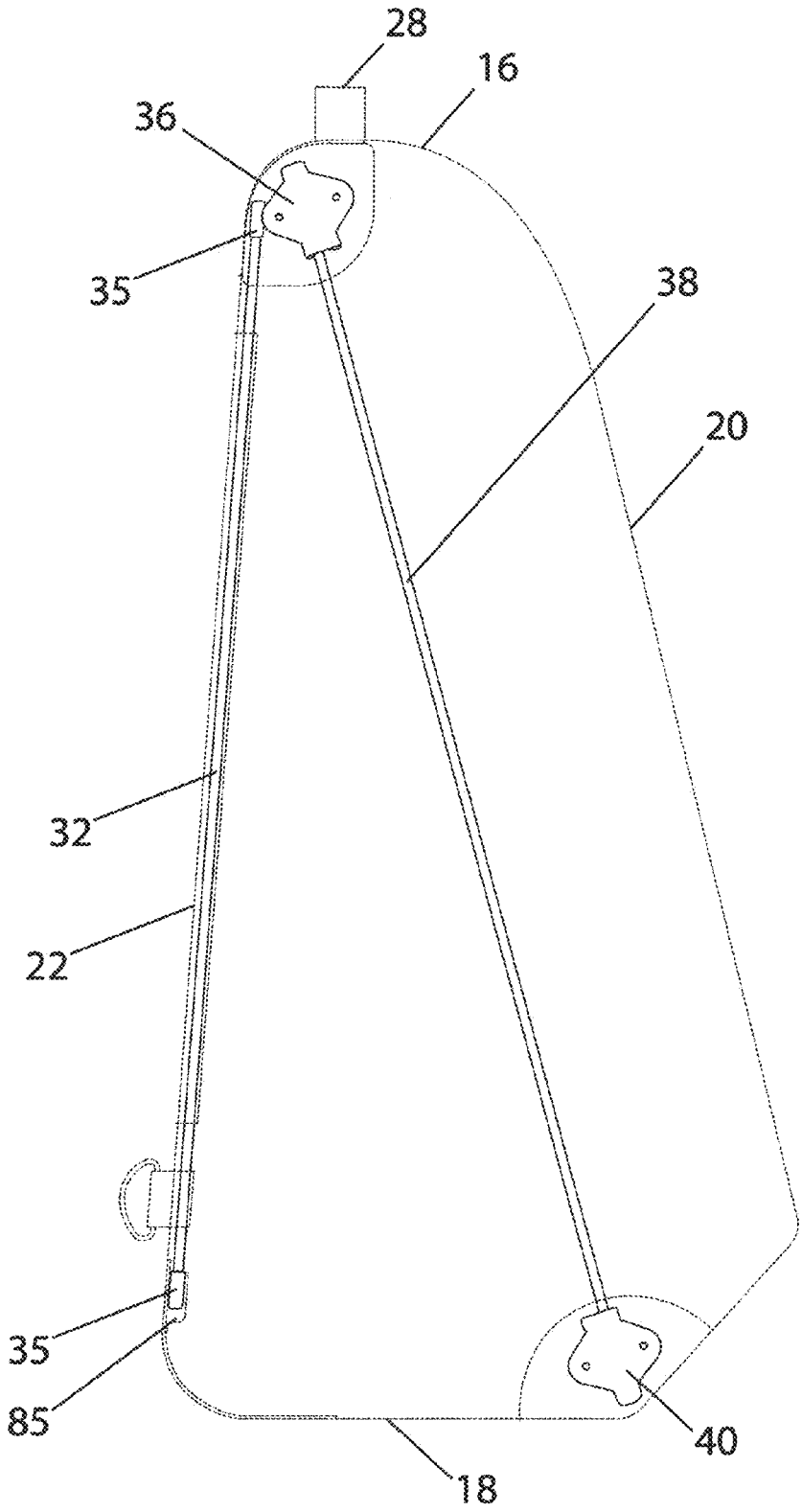
FIG. 14 is a side elevation view of a fourth embodiment of the sports bag of the present invention.
Figure 15:
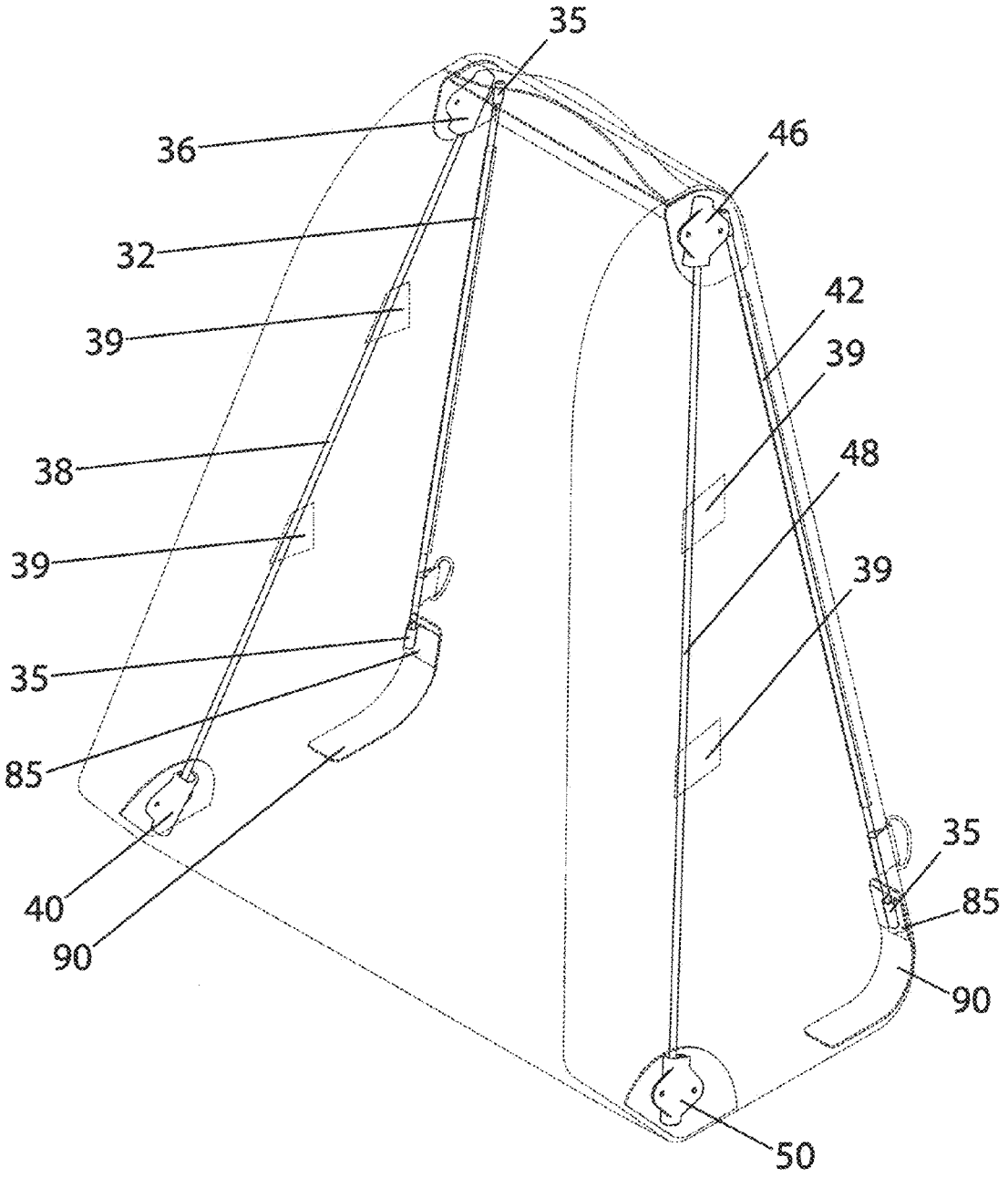
FIG. 15 is a perspective view of the fourth embodiment of the sports bag of the present invention.

FIGS. 14 and 15 show yet another embodiment of the present invention. This embodiment shows that linear rods 32 and 42 (and optionally even angled rods 38 and 48 for that matter), may be releasably engaged at a distal end thereof by means of a fabric holder 85, preferably by a webbing holder, and more preferably by a webbing holder supported by a rigid support 90, like a curved rigid support that may be made of PE plastic, as shown. A person skilled in the art would understand that they could also use an injection molded PE plastic holder for this embodiment as well.

A sports bag in accordance with the present invention may be constructed by any number of construction processes or techniques that are known to the person skilled in the art. For example, parts can be joined by stitching, attaching, welding, or adhering the various parts of the sports bag together, or of course using these techniques in combination with each other or with other techniques known in the art. Depending on the material(s) selected for use in this sports bag, it may also be possible to utilize welding, heat welding, ultrasonic welding or other welding techniques to construct the sports bag of the present invention depending on the specific materials employed. From the foregoing, it will be seen that this invention is one well adapted to attain all the ends and objects set forth above, together with other advantages which are obvious and inherent to the system and method. It will be understood that certain features and sub combinations are of utility and may be employed without reference to other features and sub combinations. This is contemplated by and is within the scope of the present invention.

What is claimed is:

1. A flexible sports bag comprising:

a flexible body defining an interior compartment, said body comprising a front panel, a back panel, a top panel, a bottom panel, and first and second side panels;

a flexible subframe disposed in the interior compartment to which the flexible body is affixed, said subframe comprising:

a first removable linear rod that extends vertically substantially the height of the back panel from a location proximate a junction of the back panel, the bottom panel and the first side panel to a location proximate a junction of the back panel, the top panel and the first side panel;

a second removable linear rod that extends vertically substantially the height of the back panel from a location proximate a junction of the back panel, the bottom panel and the second side panel to a location proximate a junction of the back panel, the top panel and the second side panel;

a first flexible angled rod that is releasably engageable with a first rod holder located proximate to the junction of the back panel, the top panel, and the first side panel and that is capable of releasably engaging with a second rod holder located proximate to a junction of the front panel, the bottom panel and the first side panel, wherein the first and second rod holders comprise an opening section to releasably and frictionally engage or house the distal ends of the first flexible angled rod, and wherein at least one of the first and second rod holders are engaged with the first side panel by riveting the at least one of the first and second rod holders to a plastic board; and a second flexible angled rod that is releasably engageable with a third rod holder located proximate to the junction of the back panel, the top panel, and the second side panel and that is capable of releasably engaging with a fourth rod holder located proximate to a junction of the front panel, the bottom panel, and the second side panel, wherein the third and fourth rod holders comprise an opening section to releasably and frictionally engage or house the distal ends of the second flexible angled rod, and wherein, when the first flexible angled rod is engaged with the first and second rod holders and the second flexible angled rod is engaged with the third and fourth rod holders, said flexible angled rods and linear rods maintain the flexible body in a semi-rigid but semi-compressible state; and wherein, when the first flexible angled rod is engaged with at most one of the first and second rod holders and the second flexible angled rod is engaged with at most one of the third and fourth rod holders, said flexible body is compressible for any one or more of storage, transport, shipping or handling.

2. A flexible sports bag as claimed in claim 1, wherein the flexible body comprises soft-sided nylon, canvas or polyester.

3. A flexible sports bag as claimed in claim 1, wherein the first and second removable linear rods are flexible.

4. A flexible sports bag as claimed in claim 1, wherein the first and second removable linear rods comprise any one of carbon fibre, pultrusion fiberglass, or pultrusion fiberglass with glass-fibre reinforced polymer or plastic material comprising epoxy, a thermosetting plastic or thermoplastic.

5. A flexible sports bag as claimed in claim 4, wherein the first and second removable linear rods comprise pultrusion fiberglass with glass-fibre reinforced with a plastic composite material comprising non-homogeneous thermoplastic resin.

6. A flexible sports bag as claimed in claim 5, wherein the first and second removable linear rods are 0.375" in diameter.

7. A flexible sports bag as claimed in claim 1, wherein the first and second flexible angled rods comprise any one of carbon fibre, pultrusion fiberglass, or pultrusion fiberglass with glass-fibre reinforced polymer or plastic material comprising epoxy, a thermosetting plastic or thermoplastic.

8. A flexible sports bag as claimed in claim 7, wherein the first and second flexible angled rods comprise pultrusion fiberglass with glass-fibre reinforced with a plastic composite material comprising non-homogeneous thermoplastic resin.

9. A flexible sports bag as claimed in claim 8, wherein the first and second flexible angled rods are 0.25" to 0.27" in diameter.

10. A flexible sports bag as claimed in claim 1, wherein the rod holders comprise an opening that is tapered.

11. A flexible sports bag as claimed in claim 1, wherein the rod holders are fabricated from plastic, fabric, metal, or synthetic plastic material.

12. A flexible sports bag as claimed in claim 11, wherein the rod holders are fabricated from injection molded polyethylene plastic.

13. A flexible sports bag as claimed in claim 1, wherein the first flexible angled rod is engageable with at least one side attachment affixed to an interior side of the first side panel and the second flexible angled rod is engageable with at least one side attachment affixed to an interior side of the second side panel.

14. A flexible sports bag as claimed in claim 13, wherein the side attachments comprise hook and loop attachments, loops of fabric stitched to the first and second side panels, or U-shaped portions of plastic stitched or riveted to the first and second side panels.

15. A flexible sports bag as claimed in claim 14, wherein the bottom panel further comprises a flexible floor portion that is vertically foldable along a lateral length of said bottom panel to increase the compressibility of the sports bag.

* * * * *